United States Patent [19]

Katsura et al.

[11] Patent Number: 4,482,628

[45] Date of Patent: Nov. 13, 1984

[54] PHOTOGRAPHIC PAPER CONTAINING MAGNESIUM OXIDE

[75] Inventors: Toru Katsura; Massashi Kubbota, both of Tokyo, Japan

[73] Assignee: Mitsubishi Paper Mills, Ltd., Tokyo, Japan

[21] Appl. No.: 186,450

[22] Filed: Sep. 12, 1980

[30] Foreign Application Priority Data

Sep. 19, 1979 [JP] Japan ..... 54/120489

[51] Int. Cl.[3] ..... G03C 1/78

[52] U.S. Cl. ..... 430/538; 162/181.4

[58] Field of Search ..... 162/181 B; 430/538

[56] References Cited

U.S. PATENT DOCUMENTS

| | | | |
|---|---|---|---|
| 3,090,705 | 5/1963 | Miksits | 162/181 B |
| 3,116,147 | 12/1963 | Uber et al. | 162/181 B |
| 3,190,789 | 6/1965 | Taylor | 162/181 B |
| 3,220,918 | 11/1965 | Shisko | 162/181 B |
| 3,253,922 | 5/1966 | Chu et al. | 96/89 |
| 3,730,830 | 5/1973 | Digcoll | 430/538 |
| 3,746,564 | 7/1973 | Parsons | 430/538 |
| 3,758,376 | 9/1973 | Beckner et al. | 162/162 |
| 4,110,155 | 8/1978 | Minagawa | 162/135 |

FOREIGN PATENT DOCUMENTS 1486729 9/1977 United Kingdom .

OTHER PUBLICATIONS

Casey, *Pulpand Paper,* second ed. vol. 11, 1960 pp. 994–995.

*Primary Examiner*—Jack P. Brammer

*Attorney, Agent, or Firm*—Cushman, Darby & Cushman

[57] ABSTRACT

A photographic paper comprising a web and a photographic emulsion coated on the web wherein the web contains at least one member selected from the group consisting of weak acid salts of magnesium, calcium and zinc and oxides of magnesium, calcium and zinc as a photographic-properties improving agent in an amount of 0.01% by weight or more based on the weight of the pulp in the web is remarkably effective on reducing unfavorable influence on photographic properties caused by chemical additives in the web. Such an effect is particularly remarkable when the web contains at least one cationic additive such as cationic sizing agent, cationic strength agent, etc.

1 Claim, No Drawings

PHOTOGRAPHIC PAPER CONTAINING MAGNESIUM OXIDE

This invention relates to photographic paper. More particularly this invention relates to photographic paper having a paper support free from bad influence of chemical additives such as a sizing agent on photographic properties.

Heretofore, chemical additives such as a dry or wet strength agent for providing dry and wet strength, a sizing agent for providing resistance to penetration of a treating solution, e.g. a developing solution, or the like have been added to photographic paper. These chemical additives are usually added to a paper stock. But most chemical additives seem to be decomposed in the paper and to react with a sensitizing dye, and the like of a photographic emulsion so as to become a sensitizer or desensitizer for the photographic emulsion, which damages photographic properties. Therefore, kinds and amounts of strength agents, sizing agents, and the like to be added to photographic paper have remarkably been limited.

As chemical additives usually used in photographic paper, there are a dry strength agent, a wet strength agent, a sizing agent, a fixing agent, a retention aid, and the like. Degree of decomposition in the paper and influences of these additives on photographic properties are different depending on the chemical compositions, conversion degree, and molecular weights of these additives, or pH of the dispersion. Therefore, although some additives are excellent in paper strength effect, sizing effect, retention effect, or the like, they cannot be used in photographic paper, which makes remarkably difficult to select proper chemical additives. Particularly, cationic materials such as cationic sizing agents, cationic strength agents, cationic fixing agents and cationic retention aids give bad influences on photographic properties and cannot be used for photographic paper at present.

The present inventors have extensively studied on causative materials in photographic paper and mechanisms of these materials causing bad influences on photographic properties and found that chemical additives such as strength agents and sizing agents are decomposed in the paper and the resulting decomposed products give bad influence on photographic properties. It has also been found that the presence of the cationic material by itself or the action of accelerating the decomposition of chemical additives such as strength agents, sizing agents by the presence of the cationic material give bad influences on photographic properties.

It is known in this art to add a deliquescent or hygroscopic salt or sulfate or halide with an object to improve electroconductivity of paper or to prevent wavy deformation at the edges of paper (e.g. U.S. Pat. Nos. 4,110,155 and 3,253,922, British Pat. No. 1,486,729, etc.). But these deliquescent or hygroscopic salts, sulfates and halides are not effective for improving photographic properties at all.

The present inventors have studied effects of addition of various metal salts to a paper stock on photographic properties with an object of suppressing decomposition of chemical additives as well as with an object of reducing bad influence of cationic materials on photographic properties and accomplished this invention.

It is an object of this invention to provide a photographic paper remarkably reduced in bad influence on photographic properties, particularly in the case of using a paper stock containing cationic materials which have bad influence on photographic properties.

This invention provides a photographic support material reduced in bad influence on photographic properties comprising a web containing therein at least one photographic-properties improving agent selected from the group consisting of weak acid salts of magnesium, magnesium oxides, weak acid salts of calcium, calcium oxides, weak acid salts of zinc and zinc oxides in an amount of 0.01% by weight or more based on the weight of the pulp in the web.

The term "photographic-properties improving agent" means an agent having a function of suppressing or remarkably reducing bad or unfavorable influence on photographic properties, particularly fogging, caused by chemical additives. The photographic-properties improving agent is at least one member selected from the group consisting of weak acid salts of magnesium, calcium and zinc, and oxides of magnesium, calcium and zinc. Among them, magnesium silicate, magnesium oxides, calcium carbonate and zinc oxides are preferable, and particularly weak acid salts of magnesium such as magnesium silicate and magnesium oxides are more preferable.

Weak acid salts of magnesium, calcium and zinc includes carbonates, silicates and oxalates of magnesium, calcium and zinc.

The amount of the photographic-properties improving agent, i.e. weak and acid salts or oxides of magnesium, calcium and zinc, to be added is 0.01% by weight or more based on the weight of the pulp in the web, and preferably 0.01 to 3.00% by weight, more preferably 0.10 to 1.00% by weight based on the weight of the pulp in the web. If the amount is less than 0.01% by weight, the effect is little, while if the amount is more than 3.00% by weight, improvement in the effect with an increased amount of the agent is reduced and if an excessive amount of the agent is added, there is a tendency to give bad influence on paper strength or sizing properties.

The web which constitues a photographic paper support of this invention can be obtained from a conventional paper stock. The paper stock is a pulp slurry containing necessary kinds and amounts of additives such as one or more fillers, dyes, dry strength agents, wet strength agents, sizing agents, fixing agents, retention aids, these additives usually being used in paper manufacturing. In the pulp slurry, as the pulp, there can be used pulp obtained from softwood, hardwood, or a mixture of softwood and hardwood by a sulfite cooking process, a kraft cooking process, a soda cooking process, an oxygen cooking process, or the like.

The paper stock can contain as the dry strength agent, oxidized starches, cationic polyacrylamide, anionic polyacrylamide, carboxy modified polyvinyl alcohol, and the like; as the sizing agent, epoxidized higher fatty acid amides, fatty acid salts, rosin, rosin derivatives such as maleic converted rosin, and the like, an alkyl ketene dimer, fatty acid anhydrides, and the like; as the filler, clay, kaolin, barium sulfate, titanium dioxide, aluminum hydroxide, magnesium hydroxide, and the like; as wet strength agent, a melamine-formaldehyde resin, a urea-formaldehyde resin, an epoxidized polyamide resin, and the like; as the fixing agent, polyethyleneimine, polyvalent metal salts such as aluminum sulfate, aluminum chloride, and the like, and cationic polymers such as cationic starch, and the like; as the pH adjusting agent, sodium hydroxide, sodium carbonate, and the like; dyes and fluorescent brightening agents; as retention aid, cationic polyacrylamide, anionic polyacrylamide, polyethyleneimine, polyamideamine, and the like.

In the case of adding cationic materials such as cationic polyacrylamide, epoxidized higher fatty acid amides, epoxidized polyamide resins, polyethyleneimine, and the like among the above-mentioned additives to the stock, there appears bad influence on photographic properties greater than the case of other additives, but such bad influence can be suppressed sufficiently by the addition of at least one member selected from the group consisting of the weak acid salts or oxides of magnesium, calcium and zinc, and the effect of this invention can be obtained.

The effect of the weak acid salts or oxides of magnesium, calcium or zinc is not influenced by whether they are soluble or insoluble, nor influenced by values of pH, electroconductivity, and zeta potential of the stock. Therefore, according to this invention, it becomes possible to use many chemical additives which have not been able to be used because of providing bad influence on photographic properties, and it also becomes possible to select kinds and amounts of chemical additives depending on their performances originally possessed.

It is advantageous to tub-size or size-press the web obtained from the stock with a solution containing one or more various water-soluble high polymers and additives. Examples of the water-soluble high polymers are oxidized starches, polyvinyl alcohol, carboxy modified polyvinyl alcohol, carboxymethyl cellulose, hydroxyethyl cellulose, cellulose sulfate, gelatin, casein, sodium polyacrylate, sodium salt of styrene-maleic anhydride copolymer, polystyrene, sodium sulfonate, and the like. Examples of the additives mentioned above are, as surface sizing agents, petroleum resin emulsions, ammonium salt of alkyl ester or styrene-maleic anhydride copolymer, emulsified alkyl ketene dimers, latices or emulsions of styrene-butadiene copolymer, ethylene-vinyl acetate copolymer, polyethylene, vinylidene chloride copolymers and the like; as inorganic electrolytes, sodium chloride, Glauber's salt, and the like; as hygroscopic materials, glycerin, polyethylene glycol, and the like; as pigments, clay, kaolin, talc, barium sulfate, titanium oxide, and the like; as pH adjusting agents, hydrochloric acid, sodium hydroxide, sodium carbonate, and the like; and dyes and fluorescent brightening agents can also be used as the additives.

The web prepared from the stock can be used as it is as a support of photographic paper. Or either one side or both sides of the web can be coated with a polyolefin resin to give a support of photographic paper. As the polyolefin resins, there can be used homopolymers or copolymers of $\alpha$-olefins such as ethylene, propylene, and the like; copolymers of two or more $\alpha$-olefins such as ethylene, propylene, and the like; copolymers of $\alpha$-olefin (as a major component) and other copolymerizable monomer or monomers; and mixtures thereof. The resins may contain one or more white pigments such as titanium oxide, zinc oxide, talc, calcium carbonate, alumina, etc.; fibrous fillers such as glass fibers, asbestos, whisker, etc.; coloring pigments such as carbon black, phthalocyanine series pigments, yellow lead, titanium yellow, red oxide, ultramarine blue, etc.; and other additives usually used in resins such as stabilizers, antioxidants, antistatic agents, plasticizers, dispersing agents, lubricants, fluorescent agents, and the like.

The polyolefin-coated paper used in this invention can be produced by, for example, a so-called extrusion coating method wherein a molten resin by heating is film casted on a running base sheet to give paper, either both sides or one side of which is coated with the resin. It is favorable to conduct an activating treatment such as corona discharge treatment, flame treatment, or the like on the base sheet before coated with the resin. The surface on which the emulsion is to be coated of the resin-coated paper can be treated, depending on its application, so as to have glazed or polished surface, matte surface, silk-finish surface, and the like, and the back side of the paper usually has a non-polished surface. The first surface or both the first and back-side surfaces can be subjected to, if necessary, activating treatment such as corona discharge treatment, flame treatment, and the like. The thickness of the resin layer of polyolefin-coated paper is not limited particularly, but usually 5 to 50 microns preferably formed by an extrusion coating method.

Further, either one side or both sides of the web prepared from the stock can be coated with a pigment to give a support of photographic paper. As pigments for pigment-coated paper, there can be used barium sulfate (baryta), clay, kaolin, talc, calcium carbonate, titanium oxide, zinc oxide, and the like. Among them, barium sulfate (baryta) is particularly preferable.

A photographic emulsion conventionally used is coated on a surface of the photographic support material of this invention, i.e. a surface of the web itself, or polyolefin resin-coated or pigment-coated surface of the web, to give papers for color photographic paper, black-and-white photographic paper, phototypography, photocopying, and the like.

As the photographic emulsion coated on the support, there can be used conventionally used one such as a silver halide color emulsion, a silver halide monochrome emulsion, or the like. As a sensitizing solution coated on the photographic support of this invention, there can be used conventionally used one such as a diazo solution, or the like.

This invention is illustrated by way of the following Examples, in which all percents are by weight unless otherwise specified.

In the following Examples, evaluation of photographic properties and measurement of sizing properties are conducted as follows.

(1) Evaluation of photographic properties

A sample of hand made paper is tightly contacted with the emulsion surface of a conventional color photographic paper and maintained at 50° C., under a moisture of 65% R.H. for 10 days. Then the hand made paper is removed and the color photographic paper is developed by a conventional method. Fog density is measured by using a Macbeth densitometer D519. The smaller value is better in photographic properties.

(2) Measurement of sizing properties

Sizing against a photographic developing solution is measured according to the Cobb sizing degree testing method described in a TAPPI standard method (T 441m-60).

EXAMPLE 1

A pulp slurry was obtained mixing a bleached kraft pulp of hardwood (LBKP) beaten in a PFI mill (C.S.F. of 350 ml) with a bleached kraft pulp of softwood (NBKP) beaten in the same manner until 450 ml in 50/50 weight ratio. To the pulp slurry, 0.5% of magnesium silicate, magnesium oxide, calcium carbonate or zinc oxide based on the weight of the pulp was added as shown in Table 1 and after sufficient stirring, 2.0% of oxidized starch was added thereto. Subsequently, 0.6% of an alkyl ketene dimer and 0.8% of polyamino-polyamide-epichlorohydrin resin were added thereto. From each stock, hand made papers A, B, C and D as listed in Table 1 having a basis weight of 160 g/m$^2$ were produced by using a TAPPI type sheet machine. These papers were dried by using a cylinder dryer at 105° C. for 10 minutes.

Photographic properties were evaluated and listed in Table 1.

COMPARATIVE EXAMPLE 1

Hand made papers E, F, G, H, and I were produced in the same manner as described in Example 1 except for adding as a metal salt 0.5% of sodium chloride, calcium chloride, magnesium chloride, sodium sulfate, or barium sulfate as shown in Table 1.

Photographic properties were evaluated and listed in Table 1.

COMPARATIVE EXAMPLE 2

Hand made paper J containing no metal salt was produced in a simillar manner as described in Example 1.

Photographic properties were evaluated and listed in Table 1.

TABLE 1

| Example No. | Hand made paper No. | Metal salt | Photographic properties (Fog) |
|---|---|---|---|
| Example 1 | A | Magnesium silicate | 0.27 |
| | B | Magnesium oxide | 0.33 |
| | C | Calcium carbonate | 0.38 |
| | D | Zinc oxide | 0.40 |
| Comparative Example 1 | E | Sodium chloride | 0.68 |
| | F | Calcium chloride | 0.67 |
| | G | Magnesium chloride | 0.67 |
| | H | Sodium sulfate | 0.71 |
| | I | Barium sulfate | 0.69 |
| Comparative Example 2 | J | None | 0.68 |

EXAMPLE 2

Hand made papers as listed in Table 2 were produced in the same manner as described in Example 1 except for charging the kinds and amounts of metal salts as listed in Table 2.

Photographic properties and sizing properties were evaluated and listed in Table 2.

TABLE 2

| Hand made paper No. | Metal salt | Amount (%) | Photographic properties (Fog) | Sizing properties (g/m$^2$) |
|---|---|---|---|---|
| K | None | 0 | 0.69 | 25.4 |
| L | Magnesium silicate | 0.01 | 0.52 | 25.4 |
| M | " | 0.10 | 0.35 | 25.2 |
| N | " | 1.00 | 0.25 | 25.6 |
| O | " | 3.00 | 0.22 | 26.2 |
| P | " | 5.00 | 0.22 | 32.2 |
| Q | Zinc oxide | 0.01 | 0.59 | 25.0 |
| R | " | 0.10 | 0.48 | 25.4 |

TABLE 2-continued

| Hand made paper No. | Metal salt | Amount (%) | Photographic properties (Fog) | Sizing properties (g/m$^2$) |
|---|---|---|---|---|
| S | " | 1.00 | 0.39 | 25.8 |
| T | " | 3.00 | 0.36 | 26.0 |
| U | " | 5.00 | 0.36 | 35.3 |

EXAMPLE 3

To the same pulp slurry as used in Example 1, 0.6% of an alkyl ketene dimer and 1.0% of polyamino-polyamide-epichlorohydrin resin based on the weight of the pulp were added to give a slurry I, 0.8% of alkenyl succinic acid anhydride and 1.5% of oxidized starch were added to give a slurry II, 1.0% of a petroleum resin series sizing agent and 1.0% of cationic polyacrylamide were added to give a slurry III. To each resulting slurry, 0.5% of magnesium silicate based on the weight of the pulp was added and each hand made paper having a basis weight of 130 g/m$^2$ was produced in the same manner as described in Example 1. Photographic properties were evaluated and listed in Table 3.

COMPARATIVE EXAMPLE 3

The procedures of Example 3 were repeated except for omitting the addition of magnesium silicate to the slurries I, II and III to give three kinds of hand made papers. Photographic properties were evaluated and listed in Table 3.

TABLE 3

| Slurry No. | Example 3 Photographic properties (Fog) | Comparative Example 3 Photographic properties (Fog) |
|---|---|---|
| I | 0.23 | 0.64 |
| II | 0.38 | 0.94 |
| III | 0.21 | 0.59 |

EXAMPLE 4, COMPARATIVE EXAMPLE 4

The hand made papers A, B, C and D produced in Example 1 and J produced in Comparative Example 2 were coated with a low-density polyethylene on both sides in 30 μm thick by using a melt extrusion coater at 330° C.

Photographic properties of the resulting polyethylene-coated papers were evaluated and listed in Table 4.

TABLE 4

| Example No. | Hand made paper No. | Metal salt | Photographic properties (Fog) |
|---|---|---|---|
| Example 4 | A | Magnesium silicate | 0.22 |
| | B | Magnesium oxide | 0.27 |
| | C | Calcium carbonate | 0.31 |
| | D | Zinc oxide | 0.33 |
| Comparative Example 4 | J | None | 0.64 |

EXAMPLE 5, COMPARATIVE EXAMPLE 5

The hand made papers A, B, C and D produced in Example 1 and J produced in Comparative Example 2 were coated with barium sulfate (baryta) on one side in 25 μm thick (in dry state).

Each of the baryta-coated surface was contacted tightly with the emulsion surface of color photographic paper and photographic properties were evaluated and listed in Table 5.

TABLE 5

| Example No. | Hand made paper No. | Metal salt | Photographic properties (Fog) |
|---|---|---|---|
| Example 5 | A | Magnesium silicate | 0.21 |
| | B | Magnesium oxide | 0.27 |
| | C | Calcium carbonate | 0.32 |
| | D | Zinc oxide | 0.34 |
| Comparative Example 5 | J | None | 0.65 |

As is clear from the test results mentioned above, the photographic paper obtained by adding at least one member selected from the group consisting of the weak acid salts and oxides of magnesium, calcium and zinc is excellent in photographic properties compared with that obtained by adding no such a metal salt or by adding other metal salts than those mentioned above irrespective of the kinds and amounts of chemical additives.

What is claimed is:

1. A photographic paper of reduced unfavorable influence on photographic properties comprising (A) a photographic paper support material which is made of a web containing at least one cationic material selected from the group consisting of cationic sizing agents, cationic strength agents, cationic fixing agents, and cationic retention aids, and (B) a photographic silver halide emulsion coated thereon, wherein said web contains therein magnesium oxide in an amount of 0.1–3.00% by based on the weight of the paper pulp in the web, as a photographic properties-improving agent which can reduce unfavorable influence on said photographic silver halide emulsion caused by said cationic material.

* * * * *